US007207767B2

(12) United States Patent
Ashihara et al.

(10) Patent No.: US 7,207,767 B2
(45) Date of Patent: Apr. 24, 2007

(54) INDUCER, AND INDUCER-EQUIPPED PUMP

(75) Inventors: Kosuke Ashihara, Tokyo (JP); Akira Goto, Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/520,760

(22) PCT Filed: Jul. 7, 2003

(86) PCT No.: PCT/JP03/08605

§ 371 (c)(1),
(2), (4) Date: Sep. 22, 2005

(87) PCT Pub. No.: WO2004/007970

PCT Pub. Date: Jan. 22, 2004

(65) Prior Publication Data

US 2006/0110245 A1 May 25, 2006

(30) Foreign Application Priority Data

Jul. 12, 2002 (JP) ..... 2002-204734

(51) Int. Cl.
*F04D 29/18* (2006.01)
*F04D 29/66* (2006.01)

(52) U.S. Cl. ..... 415/71; 415/143; 416/176

(58) Field of Classification Search ..... 415/71, 415/73, 74, 75, 143; 416/176, 177
See application file for complete search history.

(56) References Cited

U.S. PATENT DOCUMENTS 3,299,821 A 1/1967 Silvern
3,442,220 A * 5/1969 Mottram et al. ..... 415/218.1
3,522,997 A 8/1970 Rylewski
6,435,829 B1 * 8/2002 Meng et al. ..... 416/176

FOREIGN PATENT DOCUMENTS

| | | |
|---|---|---|
| JP | 60-164698 | 11/1985 |
| JP | 1-178800 | 7/1989 |
| JP | 2000-314390 | 11/2000 |

OTHER PUBLICATIONS

K. Ashihara et al.; Proceedings of ASME FEDSM2002: ASME 2002 Fluid Engineering Division Summer Meeting, Jul. 14-18, 2002, pp. 1-10, Montreal, Quebec, Canada.

Christopher E. Brennen, "Hydrodynamics of Pumps" Concepts ETI, Inc., and Oxford University Press, pp. 128-138, 1994. California Institute of Technology, Pasadena, CA.

Jakob K. Jakobsen, "Liquid Rocket Engine Turbopump Inducers", NASA SP-8052, pp. 17-24, May 1971.

* cited by examiner

*Primary Examiner*—Edward K. Look
*Assistant Examiner*—Nathan Wiehe
(74) *Attorney, Agent, or Firm*—Westerman, Hattori, Daniels & Adrian, LLP.

(57) ABSTRACT

The present invention is concerned with an axial-flow or mixed-flow inducer (3) which is disposed upstream of a main impeller (2) for improving the suction capability of a pump such as a turbopump. In the inducer (3), a blade angle ($\beta_{bt}$) from a tip ($T_1$) to a hub ($H_1$) at a blade leading edge (31) is substantially the same as an inlet flow angle ($\beta_{1-t}$) at a designed flow rate.

3 Claims, 10 Drawing Sheets

PRIOR ART FIG. 5A
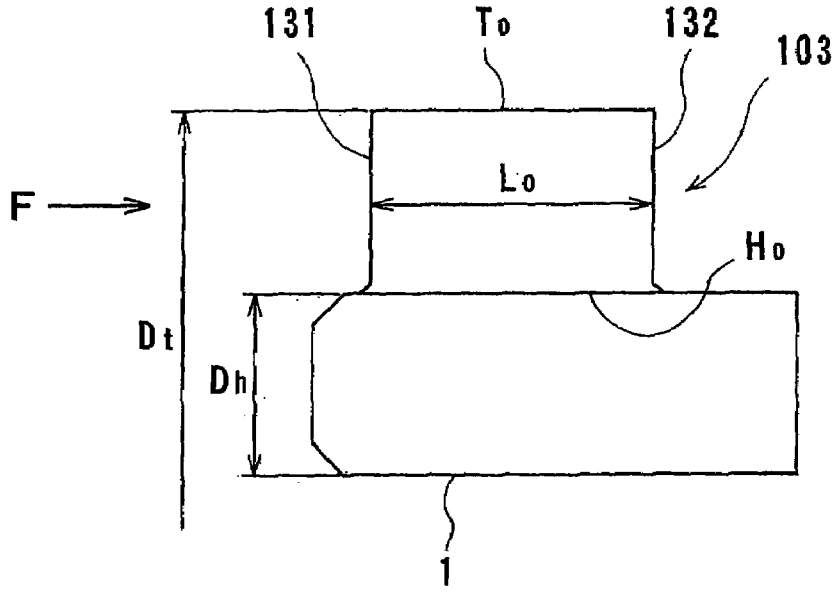
PRIOR ART FIG. 5B
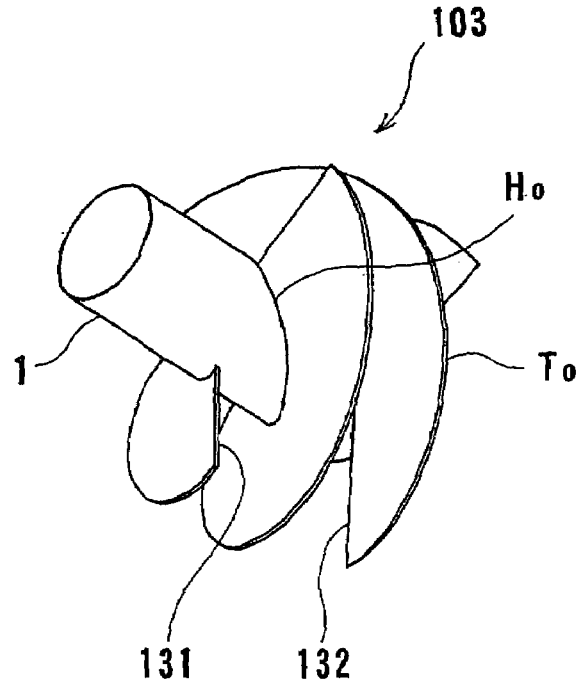

INDUCER, AND INDUCER-EQUIPPED PUMP

TECHNICAL FIELD

The present invention relates to an inducer and a pump with an inducer, and more particularly to an axial-flow or mixed-flow inducer which is disposed upstream of a main impeller with its axis aligned with an axis of the main impeller for improving the suction capability of a pump such as a turbopump, and a pump with such an inducer.

BACKGROUND ART

Heretofore, it has been customary to mount an inducer on the distal end of the shaft of a pump for improving the suction capability of the pump. For example, an inducer disposed upstream of a centrifugal main impeller comprises an axial-flow or mixed-flow impeller which has configurational characteristics in that it has less blades and a longer blade length than ordinary impellers. The inducer is disposed upstream of the main impeller with its rotational axis aligned with the main impeller, and is rotated by the shaft at the same rotational speed as the main impeller.

Conventional inducers have blades designed to be of a helical shape. In the cross-sectional shape of blades, the tip, hub, and shaft center are positioned in line. According to a conventional process of designing inducers, a blade angle is designed only along the tip, and a blade angle is determined along the hub by helical conditions. The tip blade angle on the blade leading edge of a conventional inducer is designed to be greater than an inlet flow angle which is calculated from an axial inflow velocity of the flow in the inlet at a designed flow rate and a circumferential blade speed. The differential angle between the blade angle along the tip on the blade leading edge and the inlet flow angle is referred to as an incidence angle. The incidence angle is normally designed to be in a range from 35% to 50% of the blade angle on the blade leading edge. A blade angle from the inlet (leading edge) to the outlet (trailing edge) of the tip of the inducer is designed to be constant or to increase stepwise, linearly, or quadratically in order to meet a head required for the inducer.

When an inducer thus shaped is mounted in place, even if the pressure upstream of the inlet of the blades, i.e., the pressure of a fluid in an upstream region of the pump impeller, drops locally to a level that is equal to or lower than a saturated vapor pressure, thereby causing cavitation, a flow passage following a throat of the inducer is prevented from being closed by the cavitation, and the pressure of the liquid can be increased though the cavitation is developed. With the inducer disposed upstream of the main impeller, the suction capability of the pump can be improved as compared to a case where a centrifugal main impeller were used alone, and the pump can operate at a higher speed and can be smaller in size.

However, as described above, since the tip blade angle on the blade leading edge of a conventional inducer is designed to have an incidence angle to the flow in the inlet at a designed flow rate, and to be shaped such that a distribution of tip blade angles from the inlet to the outlet is constant or increases. Therefore, loads concentrate in the vicinity of the inlet of the inducer, tending to develop a reverse flow at the inlet. If the pump is operated in a partial flow rate range which is lower than the designed flow rate, then since the incidence angle at the inlet of the inducer becomes larger, the reverse flow developed at the inlet also becomes larger in scale. If a reverse flow is developed at the inlet while cavitation is being produced, the cavitation interferes with an upstream component, which tends to be damaged by the impact pressure of the cavitation.

Furthermore, the cavitation is generated and eliminated repeatedly at a low frequency within the reverse flow at the inlet, causing the pump to vibrate greatly in its entirety. In pumps for liquid hydrogen, the thermodynamic effect of hydrogen which acts to improve the suction capability is reduced by the reverse flow at the inlet, resulting in a reduction in the suction capability of the pump.

In view of the above drawbacks, it is of practical importance to design an inducer capable of suppressing the occurrence of a reverse flow at the inlet. Heretofore, attempts have been made to improve the blade angle, blade length, number of blades, and blade tip shape of inducers in order to satisfy the suction capability and a required head. However, efforts have not been made so far to improve the blade shape of inducers for suppressing a reverse flow at the inlet. At present, consequently, there have not yet been developed inducers for suppressing a reverse flow at the inlet while satisfying a required head and the suction capability.

DISCLOSURE OF INVENTION

The present invention has been made in view of the above conventional drawbacks. It is an object of the present invention to provide an inducer and a pump with an inducer which are highly reliable and capable of suppressing a reverse flow at the inlet while satisfying a required head and the suction capability.

In order to solve the conventional drawbacks, according to a first aspect of the present invention, there is provided an inducer disposed upstream of a main impeller, characterized in that a blade angle from a tip to a hub at a blade leading edge is substantially the same as an inlet flow angle at a designed flow rate.

Since the blade angle at the blade leading edge is substantially the same as the inlet flow angle, an incidence angle of the flow at a flow rate ranging from the designed flow rate to a partial flow rate is reduced, making it possible to effectively suppress a reverse flow at the inlet.

According to a preferred aspect of the present invention, a blade angle distribution on the tip from the blade leading edge to a blade trailing edge is such that a rate of reduction of the blade angle toward the blade leading edge is greater upstream of a region in the vicinity of a throat than downstream of the region in the vicinity of the throat, and a rate of change of the blade angle is smaller in a range from the region in the vicinity of the throat toward a region in the vicinity of a distance 0.9 in a non-dimensional flow direction than upstream of the region in the vicinity of the throat. The throat refers to an inlet portion of a passage that is defined by a suction surface of a blade and an adjacent blade.

By thus making the rate of reduction of the blade angle toward the blade leading edge upstream of the region in the vicinity of the throat larger than downstream of the region in the vicinity of the throat, and also making the rate of change of the blade angle in the range from the region in the vicinity of the throat toward the region in the vicinity of the distance 0.9 in the non-dimensional flow direction smaller than upstream of the region in the vicinity of the throat, the load can be distributed entirely along the tip, and a large pressure drop region on the suction surface can be brought upstream of the throat. Therefore, most of the cavitation is generated in a front half of the suction surface of the inducer blade, and the flow passage following the throat is unlikely to be closed, allowing the pump to have a sufficient suction capability. Since the load is distributed on the entire blade along the tip, a sufficient head can be maintained.

According to a preferred aspect of the present invention, a blade angle distribution on the hub from the blade leading edge to the blade trailing edge has an inflection point in the vicinity of the throat, and is such that a rate of change of the blade angle is smaller upstream of the throat, and a rate of increase of the blade angle is larger along the direction of a flow downstream of the throat.

By thus making the rate of change of the blade angle smaller along the hub in the direction of the flow upstream of the throat, and also making the rate of increase of the blade angle larger along the hub in the direction of the flow downstream of the throat, the load can be distributed entirely on the blade along the hub, and a required head can be maintained.

According to a second aspect of the present invention, there is provided a pump with an inducer, characterized in that the pump has a main impeller mounted on a rotatable shaft, and the inducer is disposed upstream of the main impeller so as to align its axis with an axis of the main impeller.

BRIEF DESCRIPTION OF DRAWINGS

FIG. 5A is a meridional cross-sectional view of a conventional inducer, and FIG. 5B is a perspective view of the inducer shown in FIG. 5A;

BEST MODE FOR CARRYING OUT THE INVENTION

Figure 1:
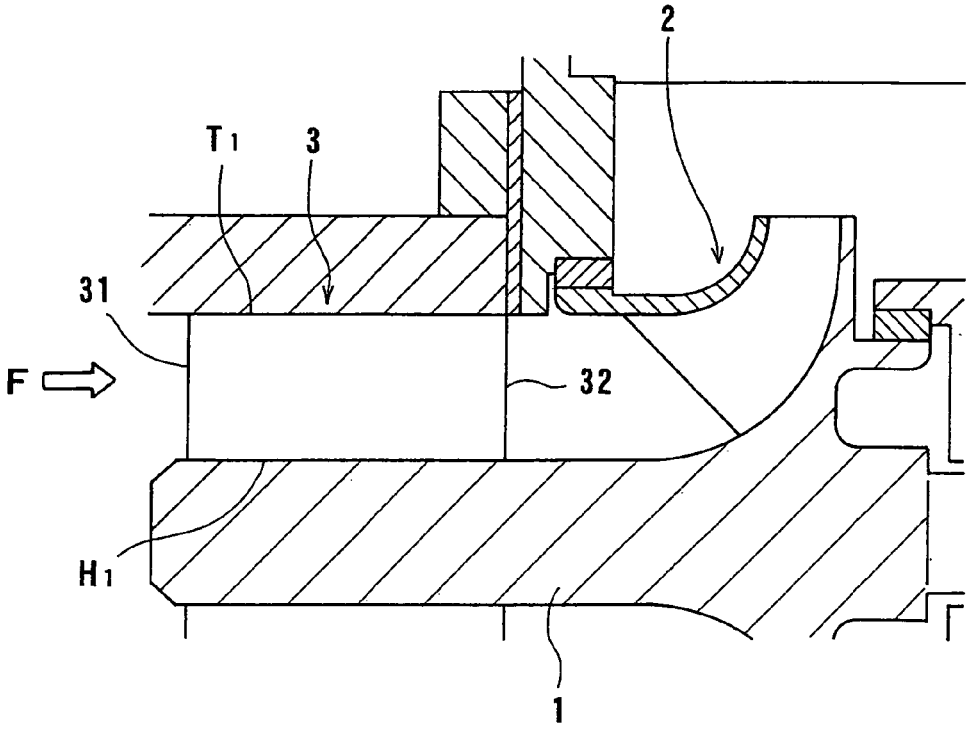
FIG. 1 is a cross-sectional view showing a portion of a turbopump incorporating an inducer according to an embodiment of the present invention.
Figure 2:
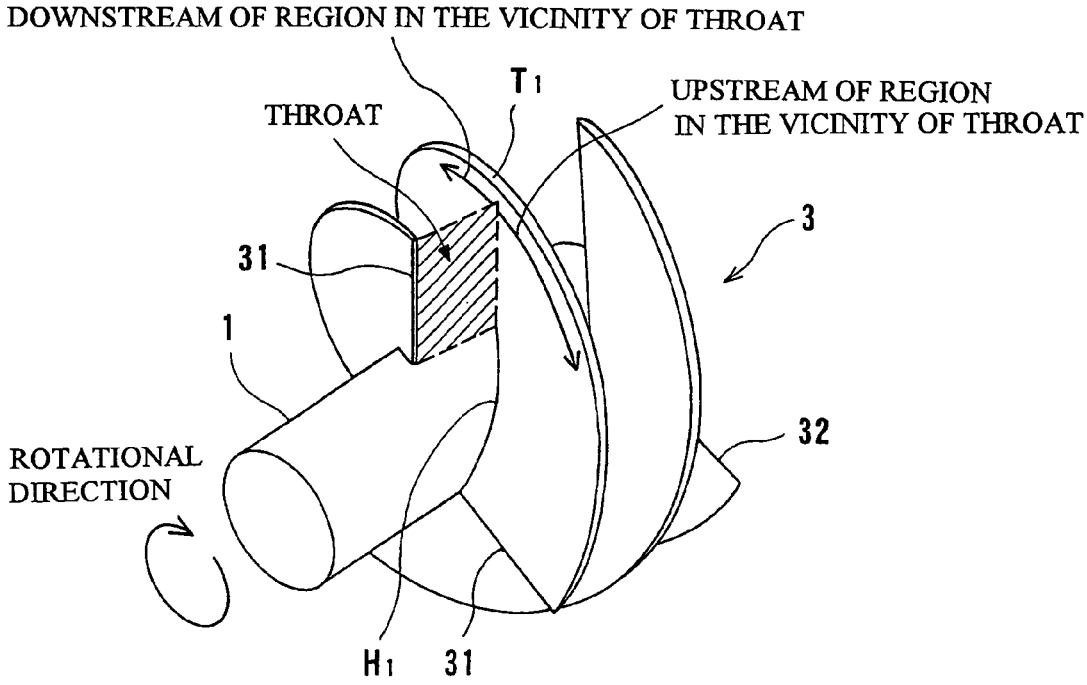
FIG. 2 is a perspective view of the inducer shown in FIG. 1.

An embodiment of an inducer and a pump with an inducer according to the present invention will be described in detail below with reference to the drawings. FIG. 1 is a cross-sectional view showing a portion of a turbopump incorporating an inducer according to an embodiment of the present invention, and FIG. 2 is a perspective view of the inducer shown in FIG. 1. The turbopump shown in FIG. 1 has a rotatable shaft 1, a main impeller 2 mounted on the shaft 1, and an inducer 3 disposed upstream of the main impeller 2. The inducer 3 has an axis in alignment with the axis of the main impeller 2. When the shaft 1 rotates, the inducer 3 rotates at the same rotational speed as the main impeller 2. The inducer 3 has a plurality of blades. In FIG. 2, the inducer 3 is shown as having three blades.

A working fluid of the pump flows into the inducer 3 in the direction indicated by the arrow F in FIG. 1. The working fluid that has flowed into the inducer 3 has its pressure increased while generating cavitation in the inducer 3. When the working fluid flows into the downstream main impeller 2, the pressure of the working fluid is further increased to a head required by the pump. Since the pressure of the working fluid is increased to a level high enough not to generate cavitation in the main impeller 2, the suction capability of the pump is improved as compared to a case where the main impeller 2 is used alone.

The inducer 3 according to the present invention has the following configurational features:

(1) The blade angle from a tip $T_1$ to a hub $H_1$ on a blade leading edge 31 is substantially the same as the inlet flow angle at the designed flow rate.

Figure 3A:
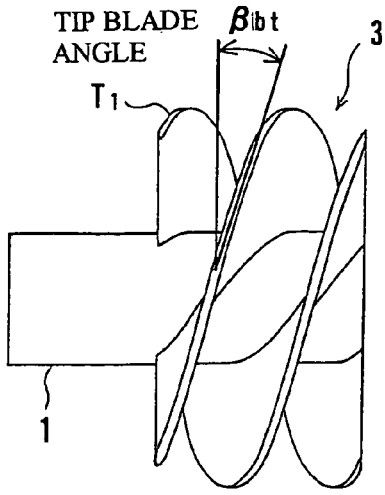
FIG. 3A is an external view showing a tip blade angle of the inducer according to the present invention, FIG. 3B an external view showing a hub blade angle, and FIG. 3C a view showing the relationship between an incidence angle, an inlet flow angle, and a tip blade angle.

(2) A blade angle distribution on the tip $T_1$ from the blade leading edge (inlet) 31 to a blade trailing edge (outlet) 32 is such that a rate of reduction of the blade angle toward the blade leading edge 31 is greater upstream of a region in the vicinity of the throat than downstream of the region in the vicinity of the throat, and a rate of change of the blade angle is smaller in a range from the region in the vicinity of the throat toward a region in the vicinity of a distance 0.9 in a non-dimensional flow direction than upstream of the region in the vicinity of the throat. The blade angle on the tip $T_1$ (tip blade angle) means an angle indicated by $\beta_{bt}$ in FIG. 3A.

Figure 3B:
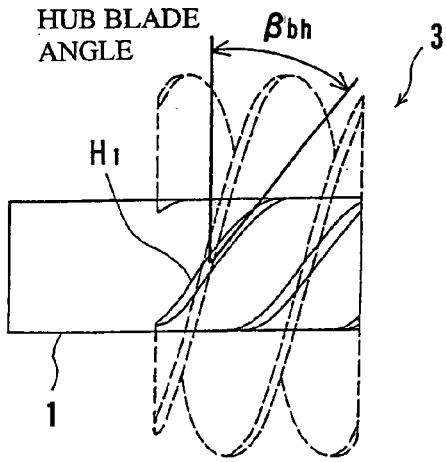

(3) A blade angle distribution on the hub $H_1$ from the blade leading edge (inlet) 31 to the blade trailing edge (outlet) 32 has an inflection point in the vicinity of the throat, and is such that a rate of change of the blade angle is small along the direction of the flow upstream of the throat, and a rate of increase of the blade angle is large downstream of the throat. The blade angle on the hub HI (hub blade angle)

means an angle indicated by $\beta_{bh}$ in FIG. 3B. In FIG. 3B, the blades of the inducer are shown by the dotted lines.

Figure 4A:
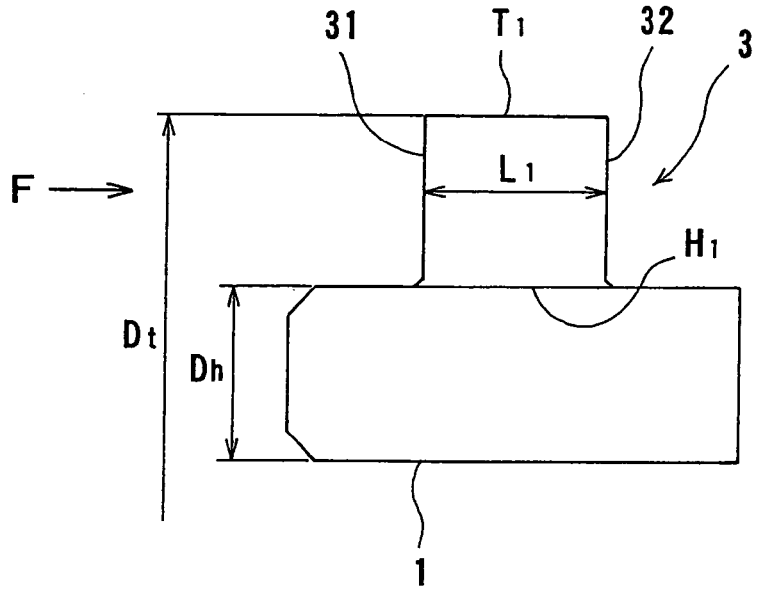
FIG. 4A is a meridional cross-sectional view of the inducer according to the present invention.
Figure 4B:
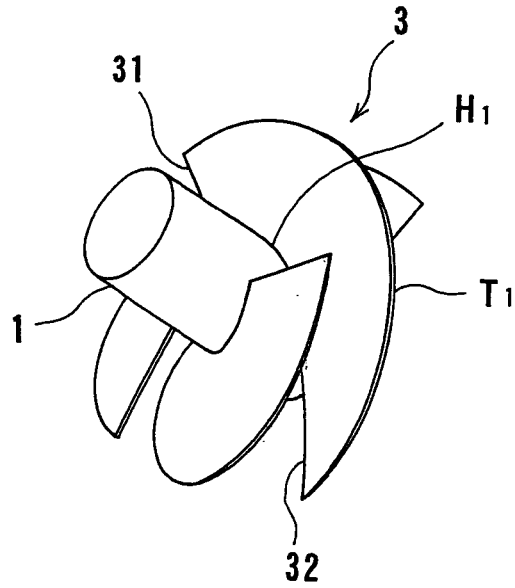
FIG. 4B is a perspective view of the inducer shown in FIG. 4A.

The inducer according to the present invention which has the above configurational features and a conventional inducer were actually designed under the conditions described below, and the inducer according to the present invention and the conventional inducer were compared with respect to their operation. FIG. 4A is a meridional cross-sectional view of the inducer 3 according to the present invention which was designed, and FIG. 4B is a perspective view of the inducer 3. FIG. 5A is a meridional cross-sectional view of the conventional inducer 103 which was designed, and FIG. 5B is a perspective view of the conventional inducer 103.

In designing the inducers 3 and 103, design requirements included a rotational speed N=3000 $min^{-1}$, a flow rate Q=0.8 $m^3$/min, and a head H=2 m, and these design requirements were the same for the conventional inducer 103 and the inducer 3 according to the present invention. The meridional shapes of the inducers 3 and 103 are of the fully axial-flow type. In the meridional cross-sectional views of FIGS. 4A and 5A, blade leading edges 31 and 131 and blade trailing edges 32 and 132 are represented by straight lines perpendicular to the flow direction F.

In the inducers 3 and 103, tips $T_1$ and $T_0$ had a diameter $D_t$=89 mm, and hubs $H_1$ and $H_0$ had a diameter $D_h$=30 mm. The conventional inducer 103 had a blade length $L_0$=50 mm in the axial direction on a meridional plane, and the inducer according to the present invention 3 had a blade length $L_1$=35 mm in the axial direction on a meridional plane. The conventional inducer 103 and the inducer 3 according to the present invention had the same actual blade length along the tip.

The conventional inducer 103 was a planar helical inducer having the same blade angle from the blade leading edge 131 to the blade trailing edge 132, and the blade angle on the tip $T_0$ was designed such that the incidence angle was 35% of the blade angle at the blade leading edge 131. The inducer according to the present invention 3 was designed such that the blade angle at the blade leading edge 31 from the tip $T_1$ to the hub $H_1$ is substantially the same as the inlet flow angle at the designed flow rate.

An axial velocity $V_x$ of the inlet flow at the designed flow rate is determined from the meridional shape of the inducer and the design requirements according to the following equation (1):

$$V_x = \frac{Q/60}{\frac{\pi}{4}(D_t^2 - D_h^2)} = \frac{0.8/60}{\frac{3.141592}{4}(0.089^2 - 0.030^2)} = 2.42[\text{m/s}] \quad (1)$$

A circumferential rotational velocity $V_{\Theta-t}$ of the inducer blade at the tip is determined according to the following equation (2):

$$V_{\theta-t} = \frac{\pi D_t N}{60} = \frac{3.141592 \times 0.089 \times 3000}{60} = 13.98[\text{m/s}] \quad (2)$$

The inlet flow angle $\beta_{1-t}$ at the tip is determined according to the following equation (3):

$$\beta_{1-t} = \text{Tan}^{-1}(V_x/V_{\Theta-t}) = \text{Tan}^{-1}(2.42/13.98) = 9.82[\text{deg}] \quad (3)$$

Figure 3C:
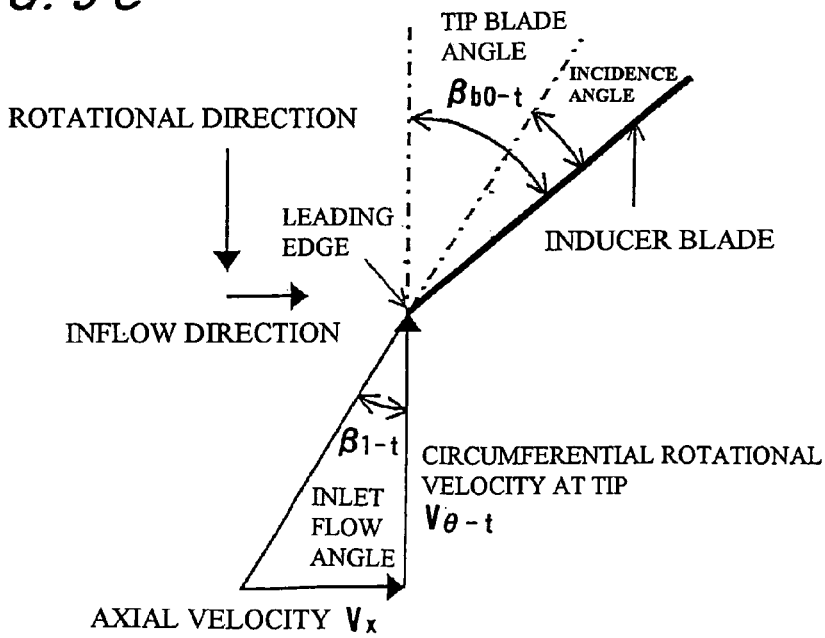

The inducer 3 according to the present invention is formed such that the blade angle of the blade leading edge 31 on the tip $T_1$ is substantially the same as the inlet flow angle $\beta_{1-t}$ at the designed flow rate. With respect to the conventional inducer, the tip blade angle $\beta_{b0-t}$ is designed such that the incidence angle is 35% of the tip blade angle $\beta_{b0-t}$. The incidence angle, the inlet flow angle $\beta_{1-t}$, and the tip blade angle $\beta_{b0-t}$ are related to each other as shown in FIG. 3C. The incidence angle is an angle produced by subtracting the inlet flow angle $\beta_{b0-t}$ from the tip blade angle $\beta_{1-t}$. That is, the tip blade angle $\beta_{b0-t}$ in the conventional inducer is determined according to the following equation (4):

$$\beta_{b0-t} - \beta_{1-t} = 0.35\beta_{b0-t}$$

$$(1-0.35)\ \beta_{b0-t} = \beta_{1-t}$$

$$\beta_{b0-t} = \beta_{1-t}(1-0.35) = 9.82/0.65 \approx 15\ [\text{deg}] \quad (4)$$

The hub blade angle $\beta_{b0-h}$ in the conventional inducer is determined from the helical conditions according to the following equation (5):

$$\beta_{b0-h} = \text{Tan}^{-1}\left(\frac{D_t}{D_h} \cdot \tan\beta_{b0-t}\right) = \text{Tan}^{-1}\left(\frac{0.089}{0.030} \cdot \tan 15\right) = 38.5[deg] \quad (5)$$

Figure 6A:
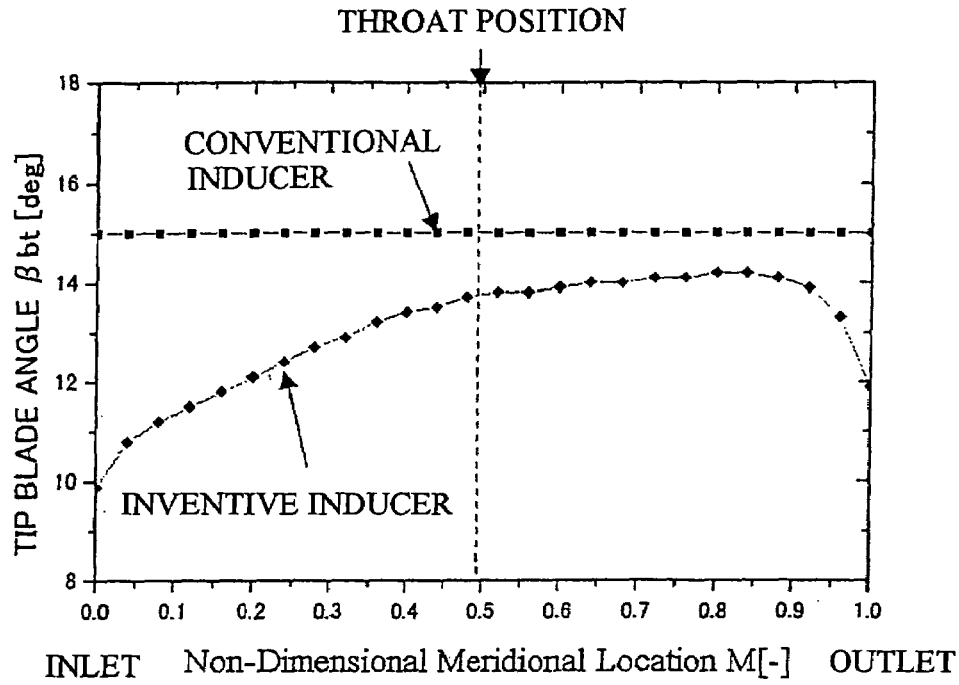
FIG. 6A is a graph showing tip blade angle distributions from a blade leading edge to a blade trailing edge of the inducer according to the present invention and a conventional inducer, respectively.
Figure 6B:
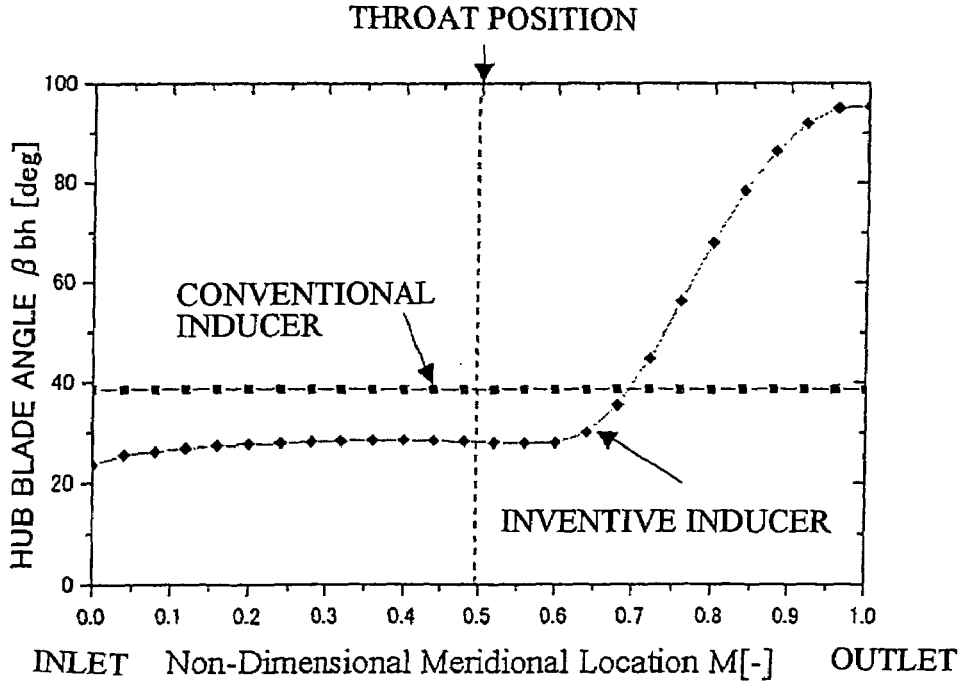
FIG. 6B is a graph showing hub blade angle distributions of the inducer according to the present invention and the conventional inducer, respectively.

FIG. 6A is a graph showing tip blade angle distributions from the blade leading edge to the blade trailing edge of the inducer according to the present invention and the conventional inducer, respectively, and FIG. 6B is a graph showing hub blade angle distributions of the inducer according to the present invention and the conventional inducer, respectively. In FIGS. 6A and 6B, the horizontal axis represents the non-dimensional meridional location normalized by the distance from the leading edge to trailing edge on the meridional plane. In FIG. 6A, the vertical axis represents the tip blade angle. In FIG. 6B, the vertical axis represents the hub blade angle.

As shown in FIGS. 6A and 6B, the inducer according to the present invention has a three-dimensional blade shape such that the blade angle changes continuously from the blade leading angle (inlet) to the blade trailing edge (outlet), and the tip blade angle and the hub blade angle change differently from each other. In order to design a three-dimensional blade shape for an inducer in which the blade angle at the blade leading edge is substantially the same as the inlet flow angle and which meets the required design requirements, it is preferable to use a three-dimensional inverse method. The three-dimensional inverse method is a method proposed by Dr. Zangeneh of UCL (University College London) in 1991. The three-dimensional inverse method is a design method for defining a loading distribution on the blade surface and determining a blade surface shape that meets the loading distribution according to numerical calculations. Details of the three-dimensional inverse method are described in a known document (Zangeneh, M., 1991, "A Compressible Three-Dimensional Design Method for Radial and Mixed Flow Turbomachinery Blades", Int. J. Numerical Methods in Fluids, Vol. 13. pp. 599–624).

The inducer according to the present invention was designed according to the three-dimensional inverse method. In the three-dimensional inverse method, entire blade loading was inputted such that the design requirements would be the same as those of the conventional inducer, a blade loading distribution was inputted such that the loading on the tip and hub blade leading edges are zero, and a fore loading distribution was inputted such that the loading would concentrate on a front portion as a whole. As a result of the designing process according to the three-dimensional inverse method, the inducer according to the present invention was designed such that the blade angle from the tip to the hub on the blade leading edge was substantially the same as the inlet flow angle at the designed flow rate, so that the incidence angle of the flow was 0°. Because of the configurational feature that makes the blade angle on the blade leading edge substantially equal to the inlet flow angle, the incidence angle of the flow at a flow rate range from the designed flow rate to a partial flow rate is reduced, making it possible to effectively suppress a reverse flow at the inlet.

As shown in FIG. 6A, the tip blade angle distribution from the blade leading edge to the blade trailing edge of the inducer according to the present invention is such that a rate of reduction of the blade angle toward the blade leading edge is larger upstream of the region in the vicinity of the throat than downstream of the region in the vicinity of the throat, and a rate of change of the blade angle is smaller in a range from the region in the vicinity of the throat toward the region in the vicinity of the distance 0.9 in the non-dimensional flow direction than upstream of the region in the vicinity of the throat. By thus making the rate of reduction of the blade angle toward the blade leading edge upstream of the region in the vicinity of the throat larger than downstream of the region in the vicinity of the throat, and also making the rate of change of the blade angle in the range from the region in the vicinity of the throat toward the region in the vicinity of the distance 0.9 in the non-dimensional flow direction smaller than upstream of the region in the vicinity of the throat, the blade loading can be distributed entirely along the tip, and a large pressure drop region on the suction surface can be brought upstream of the throat. Therefore, most of the cavitation is generated in a front half of the suction surface of the inducer blade, and the flow passage following the throat is unlikely to be closed, allowing the pump to have a sufficient suction capability. Since the blade loading is distributed on the entire blade along the tip, a sufficient head can be maintained.

As shown in FIG. 6B, the hub blade angle distribution from the blade leading edge to the blade trailing edge of the inducer according to the present invention has an inflection point in the vicinity of the throat, and is such that a rate of change of the hub blade angle is smaller along the direction of the flow upstream of the region in the vicinity of the throat than downstream of the region in the vicinity of the throat, and a rate of increase of the hub blade angle is larger downstream of the region in the vicinity of the throat than upstream of the region in the vicinity of the throat. By thus making the rate of change of the blade angle smaller along the hub in the direction of the flow upstream of the throat, and also making the rate of increase of the blade angle larger along the hub in the direction of the flow downstream of the throat, the blade loading can be distributed entirely on the blade along the hub, and a required head can be maintained.

The inducer according to the present invention and the conventional inducer were analyzed for a flow field therearound by computational fluid dynamics (CFD). The results of the analysis will be described below.

Figure 7A:
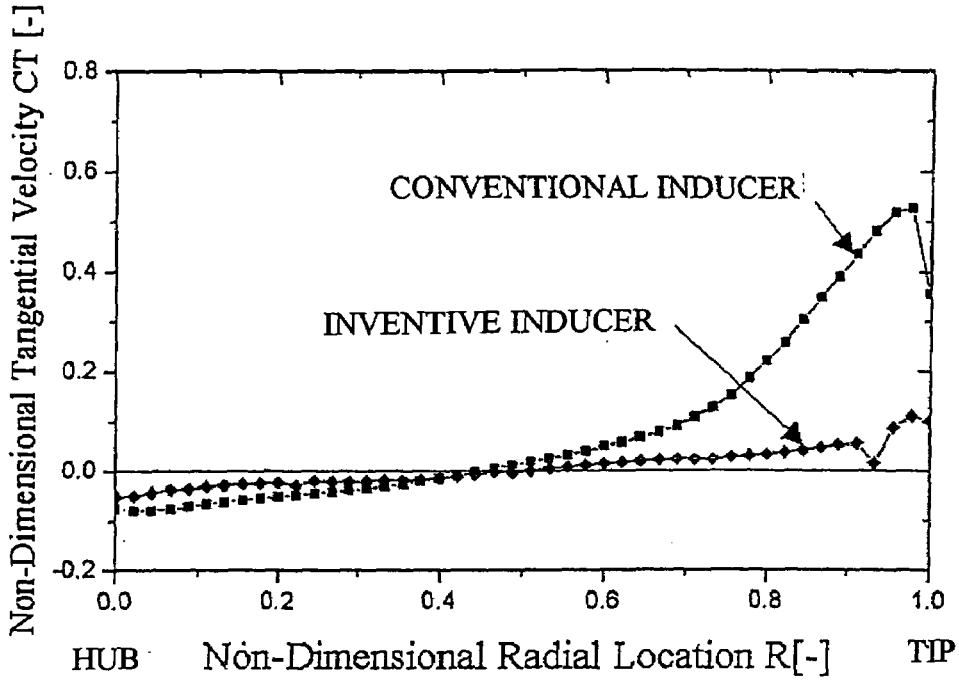
FIGS. 7A and 7B are graphs showing fluid velocity distributions between the hub and the tip at a flow rate which is 75% of a designed flow rate at a position that is 5 mm upstream of the blade leading edge of the inducer according to the present invention and the conventional inducer, FIG. 7A showing the fluid velocity distributions in the circumferential direction, and FIG. 7B the fluid velocity distributions in an axial direction.
Figure 7B:
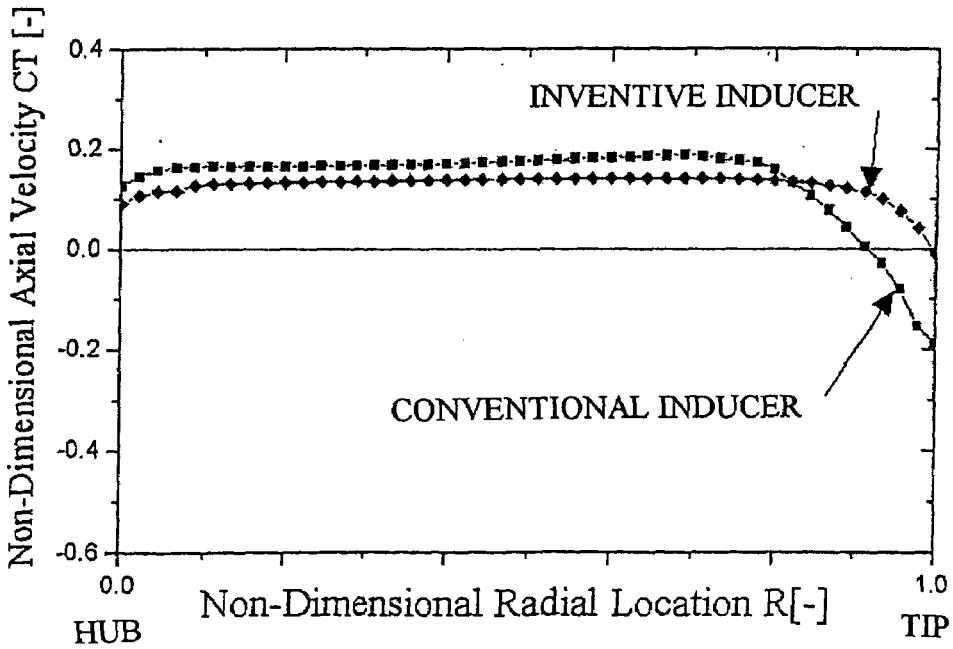

FIGS. 7A and 7B are graphs showing fluid velocity distributions between the hub and the tip at a flow rate which is 75% of the designed flow rate at a position that is 5 mm upstream of the blade leading edge of the inducer according to the present invention and the conventional inducer, FIG. 7A shows the fluid velocity distributions in the circumferential direction, and FIG. 7B shows the fluid velocity distributions in the axial direction. In FIGS. 7A and 7B, the horizontal axis represents the non-dimensional radial location normalized by the distance from the hub to the tip. In FIG. 7A, the vertical axis represents the non-dimensional circumferential velocity which is indicative of the circumferential velocity of the flow as normalized by the circumferential velocity of the tip of the inducer blade. In FIG. 7B, the vertical axis represents the non-dimensional axial velocity which is indicative of the axial velocity of the flow as normalized by the circumferential velocity of the tip of the inducer blade.

As shown in FIG. 7A, since the conventional inducer produces a reverse flow at the inlet, the circumferential velocity of the fluid on the tip is increased by the reverse flow at the inlet. As shown in FIG. 7B, since the axial velocity of the fluid in the conventional inducer is of a negative value in the vicinity of the tip, there is a region where a reverse flow is developed.

With the inducer according to the present invention, however, since the blade angle from the tip to the hub at the blade leading edge is substantially the same as the inlet flow angle at the designed flow rate, a reverse flow is unlikely to be developed at the inlet. Even at a flow rate which is 75% of the designed flow rate, there is no fluid velocity distribution representing a reverse flow at the inlet as with the conventional inducer (see FIGS. 7A and 7B).

Figure 8A:
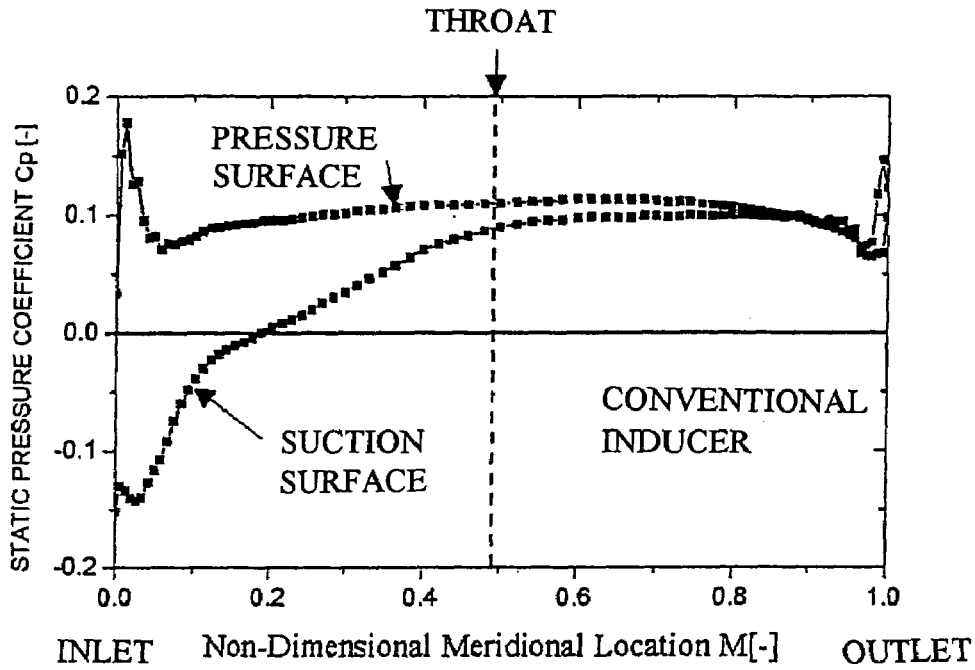
FIGS. 8A and 8B are graphs showing static pressure distributions on a blade surface along the tip at the designed flow rate, FIG. 8A showing the static pressure distributions of the conventional inducer, and FIG. 8B the static pressure distributions of the inducer according to the present invention.
Figure 8B:
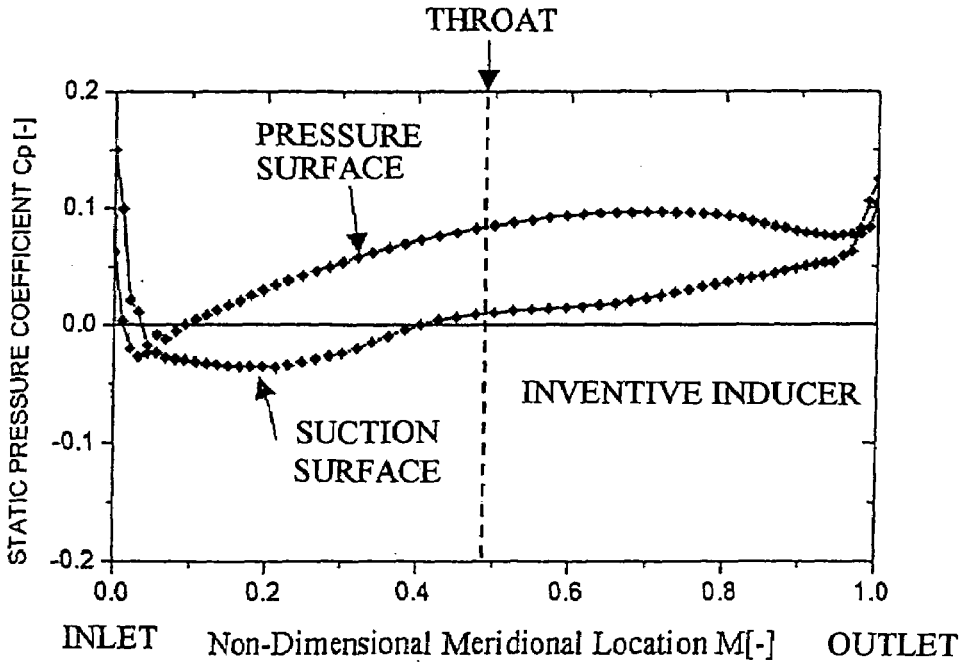

FIG. 8A shows static pressure distributions on the blade surfaces (the pressure surface and the suction surface) along the tip at the designed flow rate of the conventional inducer, and FIG. 8B shows static pressure distributions on the blade surfaces (the pressure surface and the suction surface) along the tip at the designed flow rate of the inducer according to the present invention. In FIGS. 8A and 8B, the horizontal axis represents the non-dimensional meridional location normalized by the distance from the leading edge to trailing edge on the meridional plane, and the vertical axis represents the static pressure coefficient. The pressure surface refers to a downstream blade surface, and the suction surface refers to an upstream blade surface.

As described above, because of the incidence angle between the tip blade angle and the inlet flow angle of the conventional inducer, as shown in FIG. 8A, the static pressure on the suction surface largely drops at the blade leading edge (inlet), and is widely different from the static pressure on the pressure surface. Because of this pressure distribution of the conventional inducer, it is expected that intensive cavitation is generated in the vicinity of the blade leading edge when the pressure on the blade leading edge (inlet) drops, but the flow passage following the throat is not closed.

With the inducer according to the present invention, as shown in FIG. 8B, a drop in the static pressure on the suction surface at the blade leading edge (inlet) is small, and the static pressure restores the level at the blade leading edge up to the throat. Because of this pressure distribution of the inducer according to the present invention, it is expected that weak cavitation is generated on the blade surface upstream of the throat when the pressure on the blade leading edge (inlet) drops, but the flow passage following the throat is not closed, and the inducer according to the present invention has a suction capability equivalent to that of the conventional inducer.

With the conventional inducer, the loading on the blade surfaces (the static pressure difference between the pressure surface and the suction surface) concentrates in the vicinity of the blade leading edge (inlet), with almost no load being imposed downstream (see FIG. 8A). However, the loading on the blade surfaces of the inducer according to the present invention is distributed entirely from the blade leading edge (inlet) to the blade trailing edge (outlet) (see FIG. 8B). Thus, it is expected that the inducer according to the present invention is capable of achieving the same head as the conventional inducer though the tip blade angle of the inducer according to the present invention is smaller as a whole than the tip blade angle of the conventional inducer (see FIG. 6A).

Figure 9A:
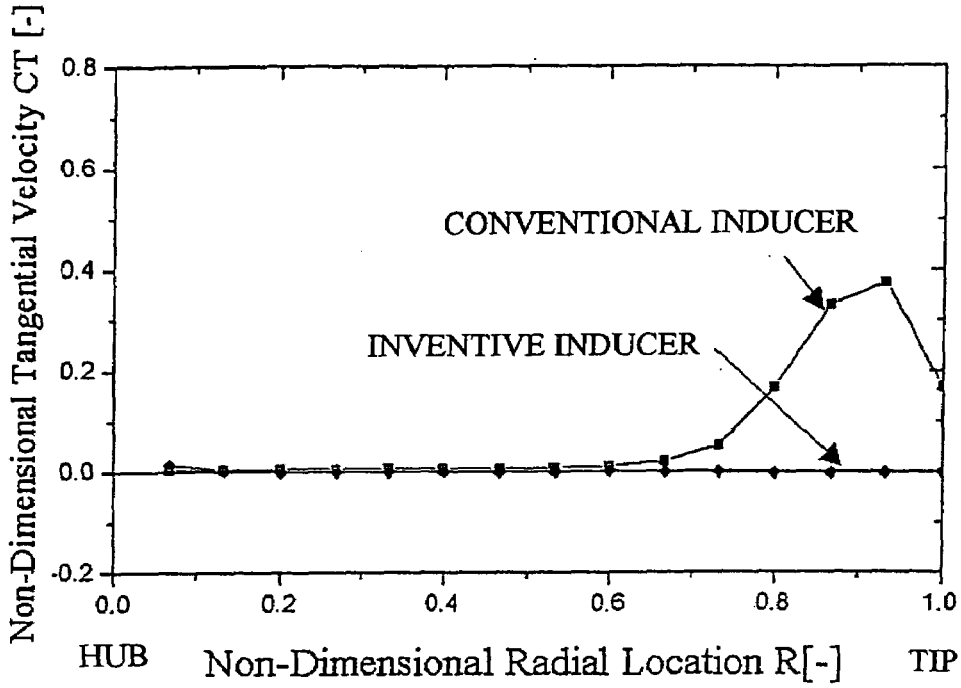
FIGS. 9A and 9B are graphs showing measured data of fluid velocity distributions at a flow rate which is 75% of the designed flow rate of the inducer according to the present invention and the conventional inducer, FIG. 9A showing the measured data of fluid velocity distributions in the circumferential direction, and FIG. 9B the measured data of fluid velocity distributions in the axial direction.
Figure 9B:
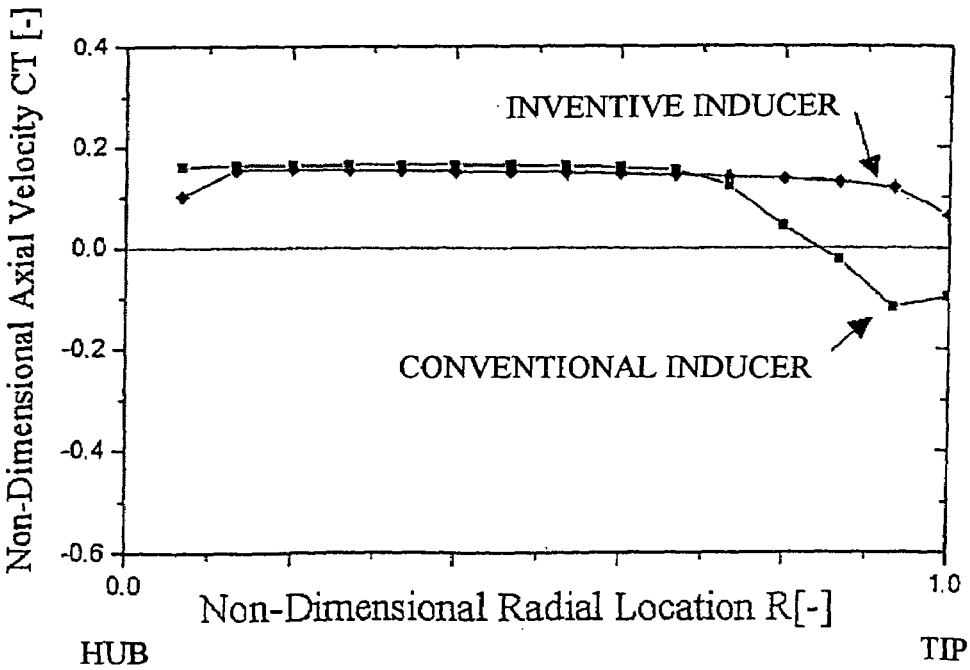

The conventional inducer and the inducer according to the present invention as described above were actually fabricated, and measured on a testing device for a circumferential velocity distribution of the fluid and an axial velocity distribution of the fluid between the hub and the tip, using a three-hole Pitot tube positioned 5 mm upstream of the blade leading edge of the inducer. FIGS. 9A and 9B are graphs showing fluid velocity distributions at a flow rate which is 75% of the designed flow rate, FIG. 9A shows the fluid velocity distributions in the circumferential direction, and FIG. 9B shows the fluid velocity distributions in the axial direction. In FIGS. 9A and 9B, the horizontal axis represents the non-dimensional meridional radial location normalized by the distance from the hub to the tip. In FIG. 9A, the vertical axis represents the non-dimensional circumferential velocity which is indicative of the circumferential velocity of the flow as normalized by the circumferential velocity of the tip of the inducer blade. In FIG. 9B, the vertical axis represents the non-dimensional axial velocity which is indicative of the axial velocity of the flow as normalized by the circumferential velocity of the tip of the inducer blade.

As shown in FIGS. 9A and 9B, since the conventional inducer produces a reverse flow at the inlet, the circumferential velocity of the fluid on the tip is increased by the reverse flow at the inlet. It was confirmed that the axial velocity of the fluid in the conventional inducer is of a negative value in the vicinity of the tip, and there is a region where a reverse flow is developed. With the inducer according to the present invention, however, even at a flow rate which is 75% of the designed flow rate, there was not confirmed any fluid velocity distribution representing a reverse flow at the inlet as with the conventional inducer. It can be understood from the above results that a reverse flow at the inlet can be suppressed in the inducer according to the present invention than in the conventional inducer.

Figure 10:
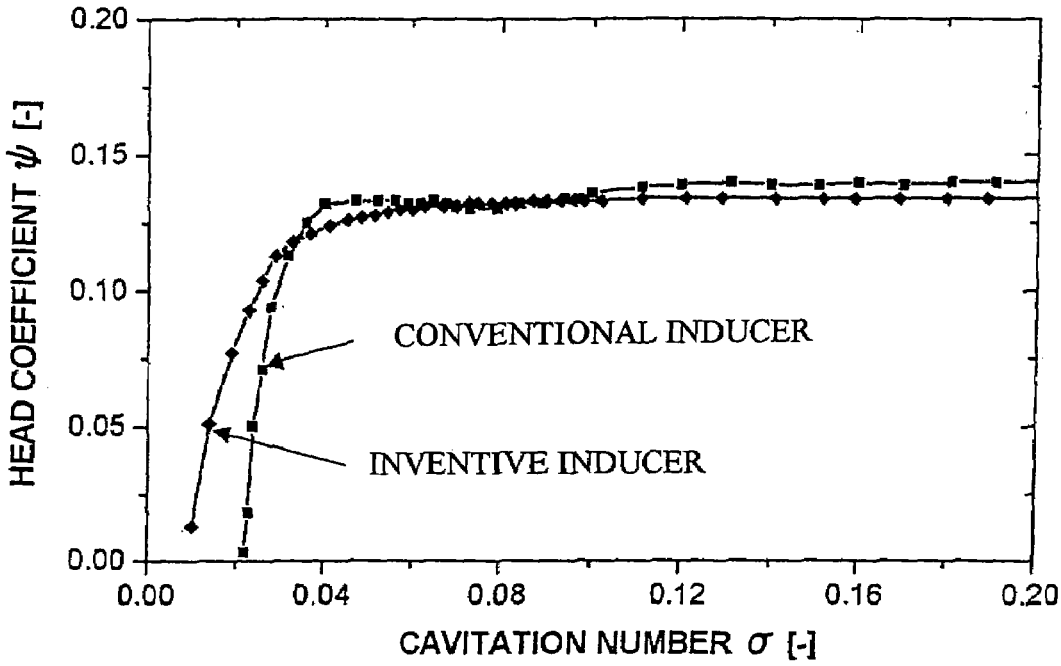
FIG. 10 is a graph showing measured data of the suction capabilities at a flow rate which is 75% of the designed flow rate of the inducer according to the present invention and the conventional inducer.

FIG. 10 shows measured data of the suction capabilities at a flow rate which is 75% of the designed flow rate. In FIG. 10, the horizontal axis represents a cavitation number where the pressure level at the blade leading edge (inlet) is made non-dimensional, and the vertical axis represents a head coefficient where the head of the inducer is made non-dimensional. The graph shown in FIG. 10 indicates variation of the head of the inducer when the pressure level at the blade leading edge (inlet) lowered. When the cavitation number decreases, cavitation is developed in the inducer, lowering the head as shown in FIG. 10. The graph shown in FIG. 10 reveals that the suction capability of the pump is so high that the head coefficient is not lowered at a lower cavitation number.

As shown in FIG. 10, the head of the inducer according to the present invention is almost the same as the head of the conventional inducer when the cavitation number is high, and the cavitation number of the inducer according to the present invention is almost the same as the cavitation number of the conventional inducer when the head drops sharply. It can be seen from these measured data that the inducer according to the present invention has the same head and suction capability as the conventional inducer.

Figure 11A:
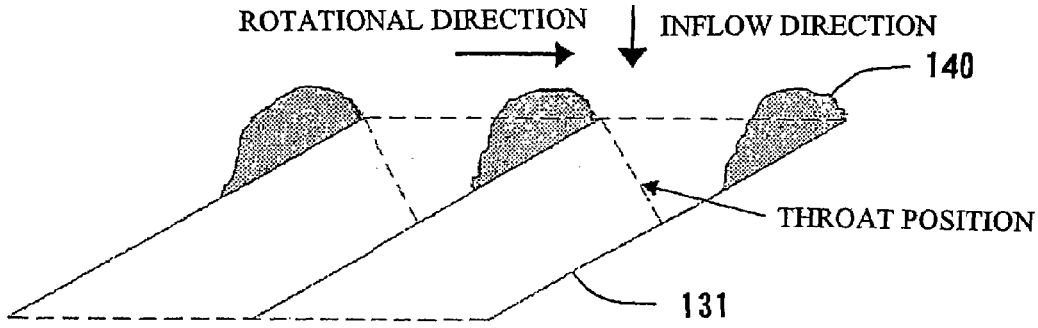
PRIOR ART FIG. 11A
FIGS. 11A and 11B are diagrams showing the manner in which cavitation is developed upstream of a blade leading edge at a flow rate which is 75% of the designed flow rate and a cavitation number of 0.08, FIG. 11A showing the measured data of the conventional inducer, and FIG. 11B the measured data of the inducer according to the present invention.
Figure 11B:
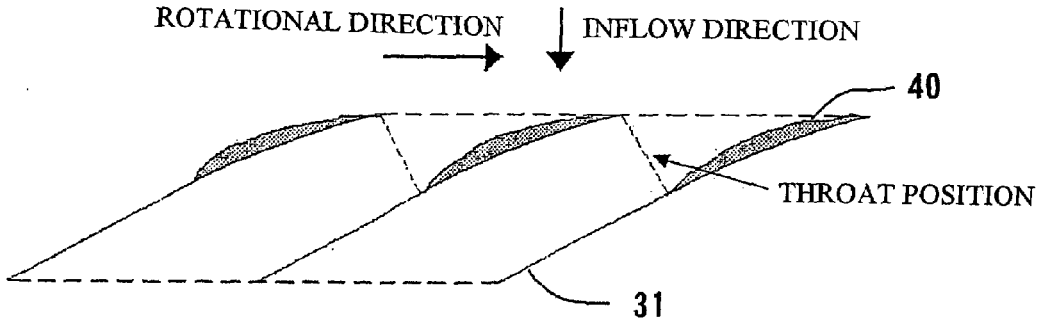

FIGS. 11A and 11B are diagrams showing the manner in which cavitation is developed upstream of the blade leading edge at a flow rate which is 75% of the designed flow rate and a cavitation number of 0.08, FIG. 11A shows the measured data of the conventional inducer, and FIG. 11B shows the measured data of the inducer according to the present invention.

As shown in FIG. 11A, in the conventional inducer, intensive cavitation 140 is developed in the vicinity of the blade leading edge (inlet) 131, and the cavitation 140 is present upstream of the blade leading edge 131 due to a reverse flow at the inlet. In the inducer according to the present invention, cavitation 40 weaker than in the conventional inducer is developed on the blade surface from the blade leading edge (inlet) 31 to the throat, but cavitation due to a reverse flow at the inlet is not essentially present upstream of the blade leading edge 31. The inducer according to the present invention is thus more effective to suppress a reverse flow at the inlet as compared to the conventional inducer, has the flow passage following the throat prevented from being closed by cavitation, and can achieve the same suction capability as the conventional inducer.

Although a certain embodiment of the present invention has been described, it should be understood that the present invention is not limited to the above embodiment, but various changes and modifications may be made within the scope of the technical concept of the invention.

As described above, the inducer according to the present invention maintains a high suction capability because a reverse flow produced at the inlet is suppressed and cavitation tends to be developed upstream of the throat and is unlikely to close the flow passage. Since the blade loading is distributed entirely on the blade surfaces, the inducer can maintain a high head. As a result, a pump combined with the inducer according to the present invention which is positioned upstream of a centrifugal main impeller is free of conventional drawbacks such as damage and vibration of upstream components, caused by a reverse flow at the inlet, and a reduction in the suction capability, and is highly reliable.

INDUSTRIAL APPLICABILITY

The present invention is applicable to an axial-flow or mixed-flow inducer disposed upstream of a main impeller for improving the suction capability of a pump such as a turbopump.

The invention claimed is:

1. An inducer disposed upstream of a main impeller, characterized in that a blade angle distribution on said tip from the blade leading edge to a blade trailing edge is such that a rate of reduction of said blade angle toward said blade leading edge is greater upstream of a region in the vicinity of a throat than downstream of the region in the vicinity of said throat, and a rate of change of said blade angle is smaller in a range from the region in the vicinity of the throat toward a region in the vicinity of a distance 0.9 in a non-dimensional flow direction than upstream of the region in the vicinity of said throat.

2. The inducer according to claim 1, characterized in that a blade angle distribution on said hub from the blade leading edge to the blade trailing edge has an inflection point in the vicinity of the throat, and is such that a rate of change of the blade angle is small upstream of the throat, and a rate of increase of the blade angle is large along the direction of a flow downstream of said throat.

3. A pump with an inducer, characterized in that said pump having a main impeller mounted on a rotatable shaft; and said inducer according to any one of claim 1 or 2 is disposed upstream of said main impeller so as to align its axis with an axis of said main impeller.

* * * * *

UNITED STATES PATENT AND TRADEMARK OFFICE

CERTIFICATE OF CORRECTION

PATENT NO. : 7,207,767 B2
APPLICATION NO. : 10/520760
DATED : April 24, 2007
INVENTOR(S) : Kosuke Ashihara et al.

It is certified that error appears in the above-identified patent and that said Letters Patent is hereby corrected as shown below:

On the Cover Page;
In item (54) the title, change "INDUCER, AND INDUCER-EQUIPPED PUMP" to be -- INDUCER AND PUMP WITH INDUCER --

Signed and Sealed this

Eighteenth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 7,207,767 B2
APPLICATION NO. : 10/520760
DATED : April 24, 2007
INVENTOR(S) : Kosuke Ashihara et al.

It is certified that error appears in the above-identified patent and that said Letters Patent is hereby corrected as shown below:

On the Cover Page and Column 1, line 1;
In item (54) the title, change "INDUCER, AND INDUCER-EQUIPPED PUMP" to be -- INDUCER AND PUMP WITH INDUCER --

This certificate supersedes the Certificate of Correction issued March 18, 2008.

Signed and Sealed this

Fifteenth Day of April, 2008

JON W. DUDAS
*Director of the United States Patent and Trademark Office*